US005496129A

United States Patent [19]

Dubé

[11] Patent Number: 5,496,129

[45] Date of Patent: Mar. 5, 1996

[54] FRANGIBLE INTERLOCKING PAVING STONE

[76] Inventor: Michael S. Dubé, 873 Longfellow St., Tracy, Calif. 95376

[21] Appl. No.: 103,433

[22] Filed: Aug. 6, 1993

[51] Int. Cl.[6] ..... E01C 5/00

[52] U.S. Cl. ..... 404/29; 404/34; 404/42; 52/603; 52/610; 52/311.2

[58] Field of Search ..... 404/34, 37, 38, 404/39, 40, 41, 42, 44; 52/603, 608, 609, 610, 611, 311.1, 311.2, 314, 100

[56] References Cited

U.S. PATENT DOCUMENTS

| | | | |
|---|---|---|---|
| 4,931 | 4/1885 | Murdock | 404/41 |
| 697,914 | 4/1902 | Griffin | 52/98 |
| 987,060 | 3/1911 | Galgano | 52/100 |
| 1,872,522 | 8/1932 | Stuckey | 264/157 |
| 2,185,497 | 1/1940 | Cilento et al. | 52/98 |
| 2,560,731 | 7/1951 | Miller | 52/125.3 |
| 2,727,382 | 12/1955 | Kurz | 52/98 |
| 3,008,256 | 11/1961 | Rice | 156/63 |
| 3,527,004 | 9/1970 | Sorensen | 52/98 |
| 3,892,902 | 7/1975 | Ilukowicz | 428/99 |
| 3,969,851 | 7/1976 | Whitacre | 52/98 |
| 4,172,344 | 10/1979 | Childress, Jr. et al. | 52/98 |
| 4,544,305 | 10/1985 | Hair | 404/41 |
| 4,583,341 | 4/1986 | Barth et al. | 404/41 |
| 4,834,575 | 5/1989 | Barth et al. | 404/39 |
| 5,046,887 | 9/1991 | Fontana et al. | 404/34 |
| 5,251,997 | 10/1993 | Brock | 404/34 |
| B1 4,128,357 | 7/1984 | Barth et al. | 52/589 |

FOREIGN PATENT DOCUMENTS

| | | | |
|---|---|---|---|
| 2021878 | 11/1971 | Germany | 404/41 |
| 0044351 | 7/1918 | Sweden | 52/610 |

OTHER PUBLICATIONS

Interpave Corp. Catalog, Dated Nov. 1, 1982, pp. 1–3 and 7.

Calstone Company, Clover Paving Stones, Brochure in its entirety.

Calstone Company, Concrete Paving Stones Flyer.

Kratzer Precast Supply, Co., Brochure in its entirety including undated 1990 and 1991 inserts.

Calpave, Uni–Group U.S.A., Brochure in its entirety including inserts for paving stones, Classico, Uni–stone, Holland–Stone, Old San Francisco Cobblestone, and Super–Decor, 1992.

PermaConcrete, Flyer.

PermaConcrete, Venus 2 Flyer.

Calstone Company, Symmetry Architectural Interlocking Paving Stone, Brochure in its entirety.

Calpave Company, Uni–Decor, Flyer in its entirety, 1988.

*Primary Examiner*—Ramon S. Britts
*Assistant Examiner*—Pamela A. O'Connor
*Attorney, Agent, or Firm*—Bernhard Kreten

[57] ABSTRACT

A paving stone (10) is provided which includes individual sectors (20, 30) of uniform size and shape. Each sector (20, 30) is joined together to form a unique pattern such as a cross-paver (10), a Z-paver (110) or an S-paver (210). Some sectors (20, 30) are tips sectors (20) which attach to only one other central sector (30) and some sectors (20, 30) are central sectors (30) which attach to two or more other top sectors (20). Each of the sectors (20, 30) extend between a common top surface (40) and a bottom surface (50). An outside surface (60) defines a periphery of the paving stone. A V-groove (80) is positioned on the top surface (40) at margins between adjacent sectors (20, 30). The V-groove (80) includes a crease (82) on a bottom thereof which encourages vertical crack propagation from the top surface (40) through to the bottom surface (50) in a plane when a appropriate force-applying tool is utilized. When this occurs the paver (10) is modified into a paver of a different shape. Spacers (66) on the outside surface (60) of the paver (10) provide interstices (90) between adjacent pavers (10).

18 Claims, 6 Drawing Sheets

FRANGIBLE INTERLOCKING PAVING STONE

FIELD OF THE INVENTION

The following invention relates to paving stones for placement on surfaces such as roadways. More particularly, this invention relates to paving stones which are frangible into separate identically shaped and sized sectors, each sector being square so that the pavers can form a gapless surface without requiring multiple uniquely shaped paving stones.

GROUND OF THE INVENTION

Heavily travelled roads made of stone paving block were first built by the Romans over 2,000 years ago. In recent times, paving stones of a man-made variety have been used in paving streets, sidewalks, runways, and other surfaces which must support heavy loads. These man-made "pavers" are typically formed from concrete including Portland cement and aggregates of various coarseness. The resulting paving stone typically supports compressive loads greater than 8,000 pounds per square inch. Also, pavers are distinguished from tile, bricks and other structures by a low percentage of voids in the concrete resulting in water absorption below 5 pounds per cubic foot. Pavers are typically designed to withstand at least 50 freeze thaw cycles. When placed in an array on a surface, these pavers exhibit great resistance to weathering and corrosion typical for high traffic bearing roadway environments.

Recently, some pavers have been provided with a shape which diverges from the standard square or rectangular brick shape. However, these pavers are still capable of fitting together with similarly shaped pavers to form a gapless surface. These pavers provide an interlocking surface which is free from long linear seams between adjacent pavers and is thus resistant to relative movement therebetween.

Some of these interlocking pavers require multiple unique complemental pavers which intermesh together. Other pavers, while having only one form, require that the pavers be cut if unique patterns are desired for the surface or if simple linear curb restraints are desired to bound the surface being covered. These interlocking pavers are sufficiently complex that it is often necessary that the paving stones be laid by a professional with the appropriate tools and experience.

Accordingly, a need exists for a paving stone which has a simple basic structure and which is frangible into discrete sectors which can then be laid together in a seamless manner. A need also exists for a paving stone which can interlock with adjacent paving stones and yet provide a linear edge which can be easily bounded by a linear curb restraint without requiring cutting of the paving stones.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| U.S. Pat. No. | ISSUE DATE | INVENTOR |
|---|---|---|
| 697,914 | April 15, 1902 | Griffin |
| 1,872,522 | August 16, 1932 | Stuckey |

-continued

| U.S. Pat. No. | ISSUE DATE | INVENTOR |
|---|---|---|
| 2,185,497 | January 2, 1940 | Cilento, et al |
| 2,560,731 | July 17, 1951 | Miller |
| 2,727,382 | December 20, 1955 | Kurz |
| 3,008,256 | November 14, 1961 | Rice |
| 3,527,004 | September 8, 1970 | Sorensen |
| 3,892,902 | July 1, 1975 | Ilukowicz |
| 3,969,851 | July 20, 1976 | Whitacre |
| 4,172,344 | October 30, 1979 | Childress, Jr., et al |
| B1 4,128,357 | July 17, 1984 | Barth, et al |
| 4,544,305 | October 1, 1985 | Hair |
| 4,583,341 | April 22, 1986 | Barth, et al |
| 4,834,575 | May 30, 1989 | Barth, et al |

OTHER PRIOR ART

Calstone Company, clover Paving Stones, Brochure in its entirety.

Calstone Company, Concrete Paving Stones Flyer.

Kratzer Precast Supply, Co., Brochure in its entirety including undated 1990 and 1991 inserts.

Calpave, Uni-Group U.S.A., Brochure in its entirety including inserts for paving stones, Classico, Uni-stone, Holland-Stone, Old San Francisco Cobblestone, and Super-Decor, 1992.

PermaConcrete, Flyer.

PermaConcrete, Venus 2 Flyer.

Calstone Company, Symmetry Architectural Interlocking Paving Stone, Brochure in its entirety.

Calpave Company, Uni-Decor, Flyer in its entirety, 1988.

The patent to Barth (U.S. Pat. No. 4,128,357) teaches the use of an interlocking paving stone including two sectors divided by a "dummy groove" therebetween. The paving stone of this invention is distinguishable from the teachings of Barth in that this invention provides a paving stone with multiple identical sectors. Furthermore, the paving stone is frangible into sectors which can be combined with other paving stones to easily surface a space bounded by linear curb restraints.

The patent to Rice teaches the use of a tile which is frangible into individual square pieces. The paving stone of this invention is distinguishable from the teachings of Rice in that this invention provides a paving stone designed for heavy load compressive strength provided for uses distinct from those which the device taught by Rice can be utilized.

The patent to Griffin teaches a brick which is dividable into distinct square sections. This invention is distinguishable from Griffin in that a paver is provided rather than a brick of inherently lesser compressive strength. Furthermore, the paving stone of this invention includes a side surface with inside and outside corners which allow for interlocking between adjacent paving stones in a manner not taught by Griffin.

The other prior art listed above, but not specifically discussed, teach other paving stones and further catalog the prior art of which the applicant is aware. These references diverge even more starkly from this invention than the references specifically distinguished above.

SUMMARY OF THE INVENTION

A paving stone is provided which is frangible into separate identical sectors. The paving stone is a rigid solid construct having a top surface parallel to and spaced from a bottom surface. The top surface includes a plurality of linear V-grooves thereon which divide the paving stone into distinct identically shaped sectors. In one form of the invention, the sectors are arranged to form a cross-paver. The cross-paver includes one central sector which is square and is bounded on each of its four sides by a square tip sector. A "cross-like" pattern is thus exhibited by the cross-paver.

The V-groove includes a crease at a bottom most portion thereof which facilitates the propagation of a crack from the top surface through to the bottom surface when the paver is struck with an appropriate tool such as a Mason's chisel. The tip sectors are bounded on three sides by an outside surface and on a fourth side adjacent the central sector with an inside surface. The inside surface is exposed when the tip sector is severed from the central sector. The outside surface has outside corners and inside corners thereon which allow the paver to interlock with adjacent pavers.

The outside surface includes spacers thereon extending from the bottom surface to the top surface. The spacers are offset from a central location of each facet of the outside surface. When another paving stone having a spacer is located adjacent the outside surface, the two spacers of the two pavers will not impact each other but will space the two paving stones apart. The cross-paver can be fragmented to form a variety of different paving stones. If one tip sector is severed from the cross-paver, a "T-shaped" paver is formed. If a second tip sector is severed from the cross-paver, either a "V-shaped" paver is formed or a linear "I-shaped" paver is formed. If three tipped sectors are severed from the cross-paver, a rectangular paver is formed.

In an alternative embodiment, the central sectors and tip sectors can be arranged with two central sectors adjacent each other and one tip sector adjacent each central sector to form either an "S-shaped" paver or a "Z-shaped" paver. The S-shaped and Z-shaped pavers both include the top surface and bottom surface similar to that of the cross-paver with V-grooves between the adjacent sectors. The S-paver and Z-paver are frangible along the V-groove to form various different pavers in a manner similar to that of the cross-paver. Because each of the sectors of the cross-paver, S-paver and Z-paver are square, individual sectors are easily combinable with unfragmented pavers or partially fragmented pavers to surface a rectangular space without gaps therein.

OBJECTS OF THE INVENTION

Accordingly, it is a primary object of the present invention to provide a paving stone having multiple sectors which is easily dividable, separating sectors of the paver from each other.

Another object of the present invention is to provide a paving stone which has a side surface with interior and exterior corners so that the paver is interlocking in nature.

Another further object of the present invention is to provide a paving stone which is aesthetically pleasing in appearance.

Another further object of the present invention is to provide a paving stone which is originally manufactured in a single shape, but which can be easily modified thereafter into multiple distinct shapes.

Another further object of the present invention is to provide a paving stone which has individual square sectors of uniform size which easily fill a rectangular space without requiring cutting of the sectors.

Another further object of the present invention is to provide a paving stone which has a minimum compressive strength not less than 5,000 pounds per square inch.

Another further object of the present invention is to provide a paving stone which can be divided into separate sectors, with each sector utilizable upon a surface to be paved, thereby minimizing waste of sectors of the paving stone.

Another further object of the present invention is to provide a paving stone which can be utilized by a person with limited experience in laying paving stones.

Another further object of the present invention is to provide a paving stone which lends itself to simple manufacture from low cost materials.

Viewed from a first vantage point, it is an object of the present invention to provide a paving stone for supporting a load above a surface, the paving stone comprising in combination, a solid mass of load supporting material interposed between a top surface and a bottom surface, the mass consisting of a plurality of tetragonal sectors, each said sector extending from the top surface to the bottom surface.

Viewed from a second vantage point, it is an object of the present invention to provide a set of interlocking frangible paving stones of uniform shape, each comprising in combination, a top surface, a bottom surface spaced from the top surface by a load supporting material, a plurality of linear grooves on the top surface, said grooves oriented to divide the paving stones into sectors, and a means to facilitate substantially linear separation of said sectors from each other.

Viewed from a third vantage point, it is the object of the present invention to provide a method for covering a surface with a load supporting material including the steps of providing a plurality of similarly shaped paving stones having a top surface spaced from a bottom surface, the stones each having multiple identically shaped sectors, each sector divided from adjacent sectors by a groove in the top surface, the paving stones being interlocking by having a side surface including inside corners and outside corners therein, setting the paving stones in place on the surface, identifying gaps between adjacent paving stones of a size similar to sectors of the paving stones, separating sectors away from a paving stone not yet in place on the surface, and placing the sectors in the gaps identified in said identifying steps, whereby a gapless covering of paving stones is provided on the surface.

These and other objects will be made manifest when considering the following detailed specification when taken in conjunction with the appended drawing figures.

DESCRIPTION OF PREFERRED EMBODIMENTS

Figure 1:
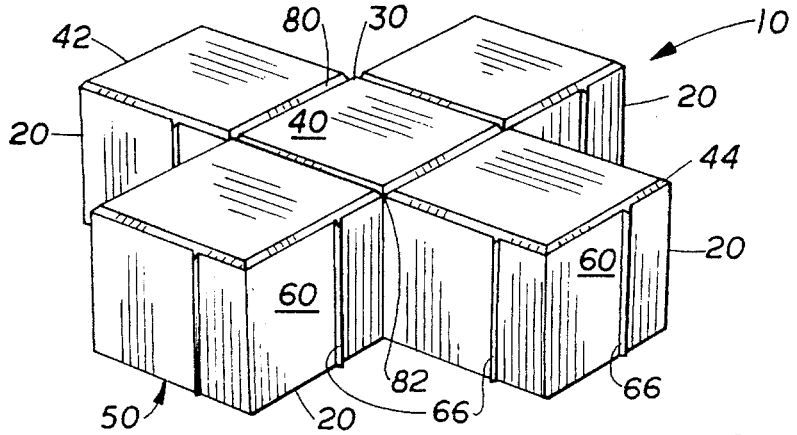
FIG. 1 is a perspective view of the paving stone of this invention.

Referring to the drawings wherein like reference numerals represent like parts throughout, reference numeral 10 (FIG. 1) is directed to a cross-paver which is a paving stone having a central sector 30 and tip sectors 20 combined together. The cross-paver 10 is combinable with other similarly shaped paving stones in covering an area to be surfaced. The cross-paver 10 functions as a pavement material for use as a road structure or other type of traffic bearing surface.

Figure 2:
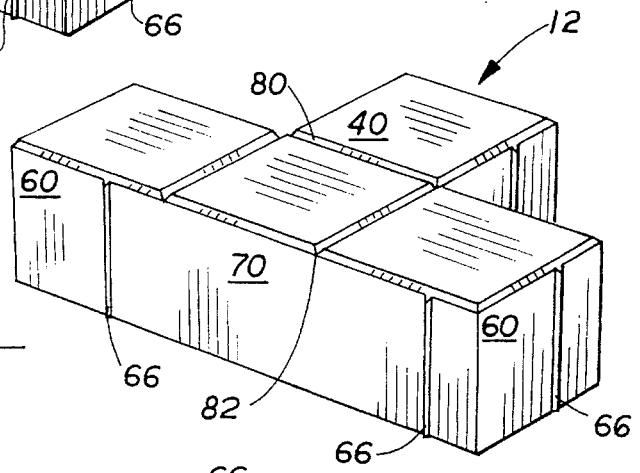
FIG. 2 is a perspective view of that which is shown in FIG. 1 with one sector thereof severed therefrom.

In essence, and referring to FIGS. 1 and 2, the cross-paver 10 includes four square tip sectors 20 surrounding a square central sector 30. The cross-paver 10 includes a top surface 40 parallel to and spaced from a bottom surface 50. A periphery of the cross-paver 10 is defined by the outside surface 60 extending perpendicularly between the top surface 40 and the bottom surface 50. A V-groove 80 is provided at the junction between each tip sector 20 and the central sector 30. The cross-paver 10 is dividable at each V-groove 80 to fragment the cross-paver 10 into one of a variety of modified cross-pavers.

Figure 3:
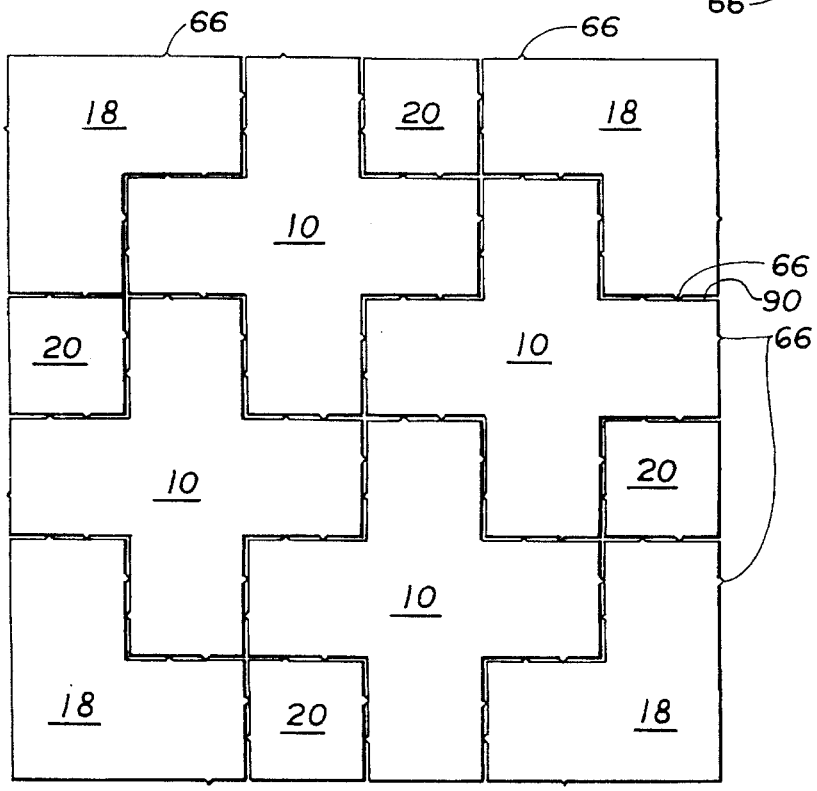
FIG. 3 is a plan view of a plurality of paving stones of this invention, some of which have had sectors fragmented therefrom, and which are arranged to fill a square space.

An inside surface 70 is exposed on a side of the central sector 30 between the top surface 40 and the bottom surface 50 when one of the tip sectors 20 is separated from the central sector 30. Spacers 66 are provided on the outside surface 60 which space the cross-paver 10 slightly from adjacent cross-pavers 10 providing an interstice 90 for the location of intersticial material therebetween and for expansion and contraction of the cross-paver 10 and substances within the interstice 90. When the cross-paver 10 is fragmented into individual tip sectors 20 and subsets of the originally undivided cross-paver 10, the uniquely shaped tip sectors 20 and the cross-pavers 10 can be combined together to form a gapless surface (FIG. 3).

Figure 4:
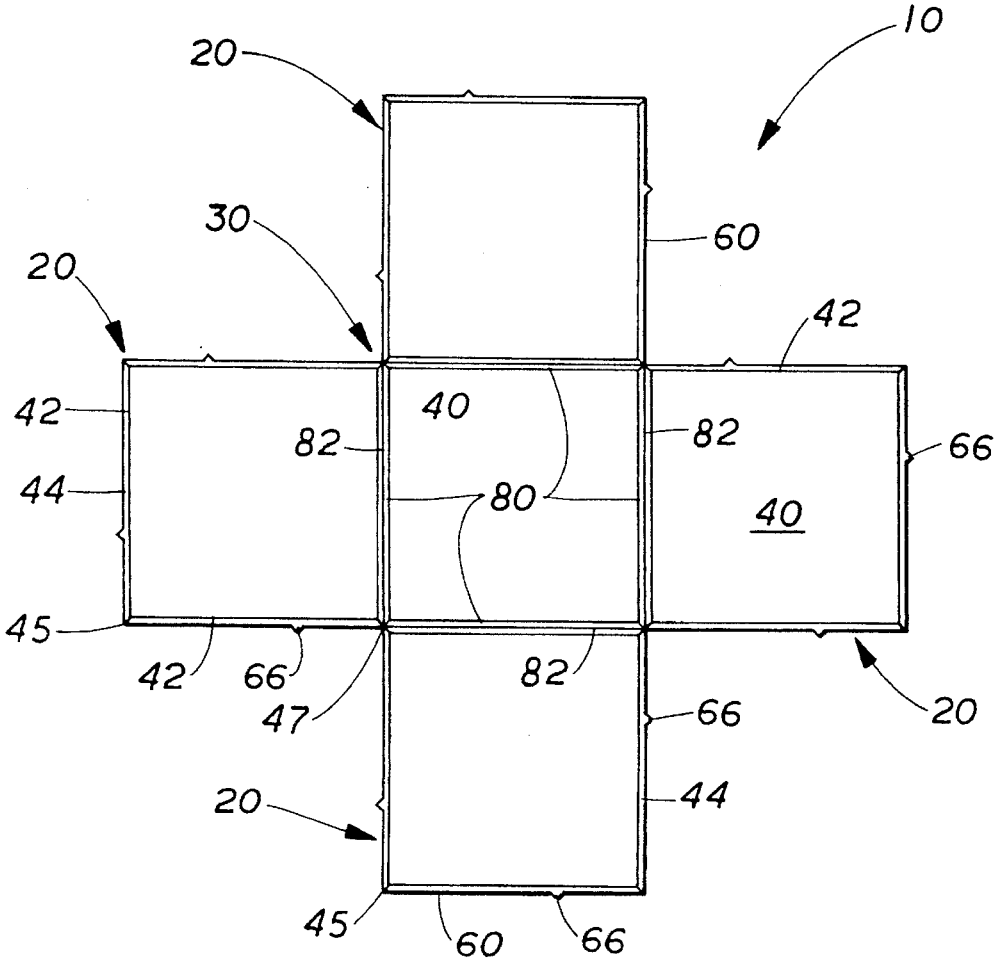
FIG. 4 is a top view of that which is shown in FIG. 1.
Figure 5:
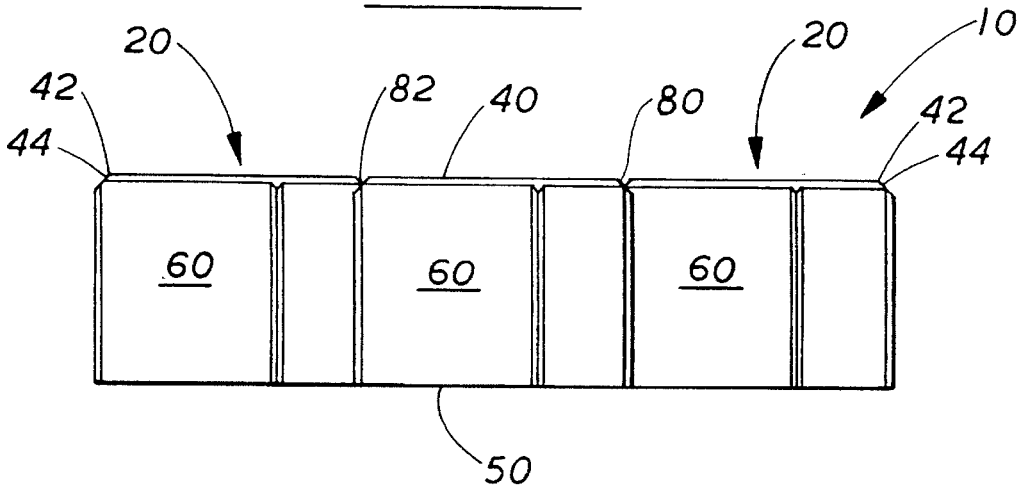
FIG. 5 is a front elevational view of that which is shown in FIG. 1.
Figure 6:
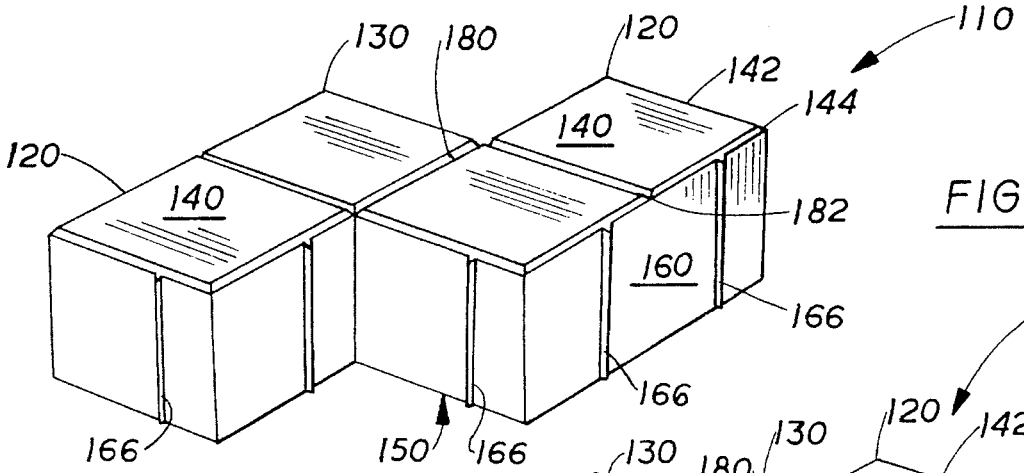
FIG. 6 is a perspective view of a paving stone which represents an alternative embodiment of this invention.

More specifically, and referring in detail to FIGS. 1, 4 and 5, details of the cross-paver 10 are shown. The cross-paver 10 includes four tip sectors 20 attached to a central sector 30. The sectors 20, 30 together form the cross-paver 10. The cross-paver 10 includes a top surface 40 parallel to and spaced from a bottom surface 50. The top surface 40 and bottom surface 50 extend over both the central sector 30 and tip sectors 20. An outside surface 60 surrounds a periphery of the cross-paver 10 and extends perpendicularly between the top surface 40 and the bottom surface 50. The cross-paver 10 includes a mass of load supporting material formed from no-slump concrete including portland cement and a combination of fine and coarse aggregates.

Each sector 20, 30 is preferably of identically tetragonal shape and size. Thus, each sector 20, 30 has six sides with each side parallel to and spaced from an opposite side. Portions of each sector 20, 30 coplanar with the top surface 40 and the bottom surface 50 are arranged as squares.

An edge 42 surrounds the top surface 40 of each tip sector 20 except on a side of the tip sector 20 adjacent the central sector 30. The edges 42 are joined together on each tip sector 20 at outside corners 45. Each outside corner 45 preferably subtends 90° degrees. Outside surfaces 60 adjacent tip sectors 20 meet at an inside corner 47, such that the two tip sectors 20 and the central sector 30 subtend 270° at the inside corners 47. Because the cross-paver 10 includes both inside corners 47 and outside corners 45, the cross-paver 10 functions as an interlocking paver. The cross-paver 10 resists lateral shearing motion between adjacent cross-pavers 10 which would deform a surface upon which the cross-pavers 10 are laid.

Each edge 42 of the tip sectors 20 is beveled along a bevel 44 which is preferably at an angle intermediate between an orientation of the top surface 40 and an orientation of the outside surface 60 (i.e. 45° from horizontal). Each outside surface 60 includes a spacer 66 thereon. The spacer 66 is essentially a hump of material extending outward from the outside surface 60 and extending from the bottom surface 50 up to the top surface 40. The spacer 66 is beveled by the bevel 44 along with the edge 42.

Each individual planar facet of the outside surface 60 includes one spacer 66 thereon. The spacer 66 is spaced from a central location of each facet of the outside surface 60 by a constant amount. Each of the spacers 66 is spaced to either the left or the right of the center of each facet of the outside surface 60. If one spacer 66 is to the left of the center of each facet of the outside surface 60, then each of the spacers 66 is positioned to the left of the center of its facet. Alternatively, if one of the spacers 66 is spaced to the right of the center of each facet of the outside surface 60 (as shown), then each of the spacers 66 is located to the right of a center of each facet of the outside surface 60. In this way, when adjacent cross-pavers 10 are positioned adjacent each other, the spacers 66 are positioned so they will not abut. Thus, each facet of the outside surface 60 is provided with two contact points with an adjacent cross-paver 10 (FIG. 3), providing stability to an array of cross-pavers 10 placed adjacent each other.

Referring now to FIGS. 2 and 3, details of the cross-paver 10 when modified are shown. The top surface 40 of the cross-paver 10 includes a plurality of V-grooves 80 thereon. Each V-groove 80 is positioned along a margin between a tip sector 20 and the adjacent central sector 30. Thus, the V-groove 80 has four linear segments which surround the central sector 30 of the cross-paver 10 and which join each other near the inside corners 47 of the cross-paver 10.

The V-groove 80 has sides which slope down to a crease 82 at a bottom of the V-groove 80. The crease 82 facilitates cracking of the cross-paver 10 vertically downward below the crease 82 from the top surface 40 to the bottom surface 50. To perform this cracking process, a user can utilize a tool which applies force along the crease 82 of the V-groove 80, such as a brick chisel.

Once this force is applied, and the tip sector 20 is severed from the central sector 30, the cross-paver 10 is modified into a modified cross-paver 12. The modified cross-paver 12 includes the central sector 30 with three tip sectors 20 attached thereto in a "T-shaped" arrangement. A surface below the V-groove 80 where the tip sector 20 has been removed defines an inside surface 70 of the modified cross-paver 12. The inside surface 70 is similar to the outside surface 60 except that no spacer 66 is located upon the inside surface 70. The V-groove 80 is configured so that when the tip sector 20 is removed therefrom, one wall of the V-groove 80 simulates the appearance of the bevel 44 of the edge 42.

A second modified cross-paver 18 (FIG. 3) can be generated by severing another tip sector 20 from the modified cross-paver 12 (FIG. 2) which was adjacent to the first tip sector 20 removed from the cross-paver 10. A second modified cross-paver 18 exhibits a "V-shaped" appearance when viewed from above. Furthermore, other modified cross-pavers can be created by separating two tip sectors 20 from a cross-paver 10, the two tip sectors 20 being non-adjacent to each other. Also, by severing three tip sectors 20 from the cross-paver 10, a unique paver can be created. Accordingly, five different pavers can be generated by modifying the original cross-paver 10. Also, the individual sectors 20, 30 provide a sixth paver for utilization in conjunction with the other pavers.

As shown in FIG. 3, the cross-pavers 10, modified cross-pavers 18, and tip sectors 20, can be combined together in a square area and fill the square area without vacant gaps between the pavers 10, 18, 20. The pattern exhibited in FIG. 3 is merely one of a variety of different possible patterns creatable. By including different colors in the pattern, still greater variety can be achieved.

Referring now to FIGS. 6 through 10, an alternative embodiment of the cross-paver 10 is shown. Reference numeral 110 is directed to a "Z-shaped" paver similar to the cross-paver 10 except for the arrangement of the sectors 20, 30. The Z-paver 110 includes two central sectors 130 and two tip sectors 120. Each central sector 130 is attached to the other central sector 130 on one side and to a tip sector 120 on a side of each central sector 130 which is not directly opposite the side connected to the other central sector 130.

The tip sectors 20 are connected to sides of the central sector 30 which cause the Z-paver 110 to have a "Z-shaped" appearance when viewed from above a top surface 140 of the Z-paver 110. The top surface 140 is spaced from a bottom surface 150 in a manner similar to that exhibited by the cross-paver 10. Each of the tip sectors 120 and central sectors 130 is similar in appearance to the central sectors 30 and tip sectors 20 of the cross-paver 10. However, with the Z-paver 110,spacers 166 are provided not only on three outside surfaces 160 of the tip sectors 120 but are also located on two outside surfaces 160 of the central sectors 130. Also, the outside surface 160 of the Z-paver 110 includes some facets which are twice as long as other facets.

The Z-paver 110 includes a plurality of V-grooves 180 arranged between the two central sectors 130 and between the central sectors 130 and the tip sectors 120, in a manner similar to that of the cross-paver 10. A crease 182 is formed at a bottom of the V-groove 180. Other details of the V-grooves 180 are identical to the details of the V-grooves 80 of the cross-paver 10.

Figure 7:
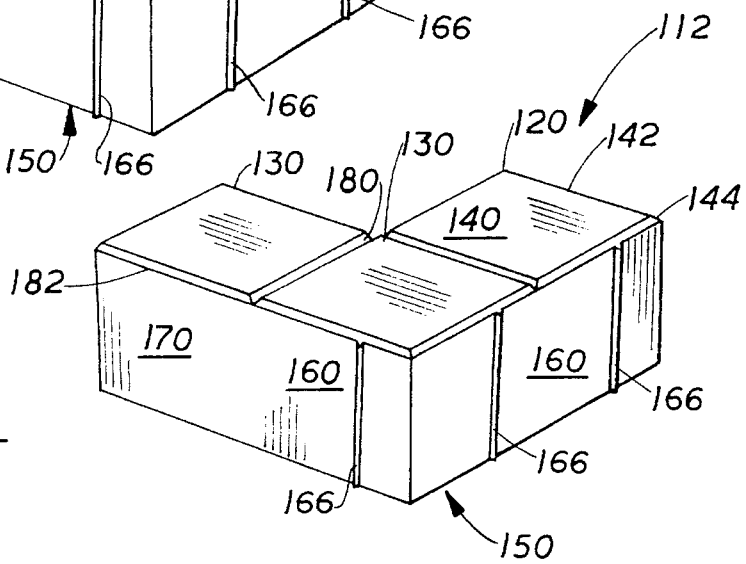
FIG. 7 is a perspective view of the paving stone shown in FIG. 6 with a sector thereof separated therefrom.

As shown in FIG. 7, the Z-paver 110 can be fragmented by removing a tip sector 120 therefrom and creating a modified Z-paver 112. If an additional tip sector 120 is removed from the modified cross-paver 112, a second modified Z-paver 114 is created of an approximately rectangular shape.

Figure 8:
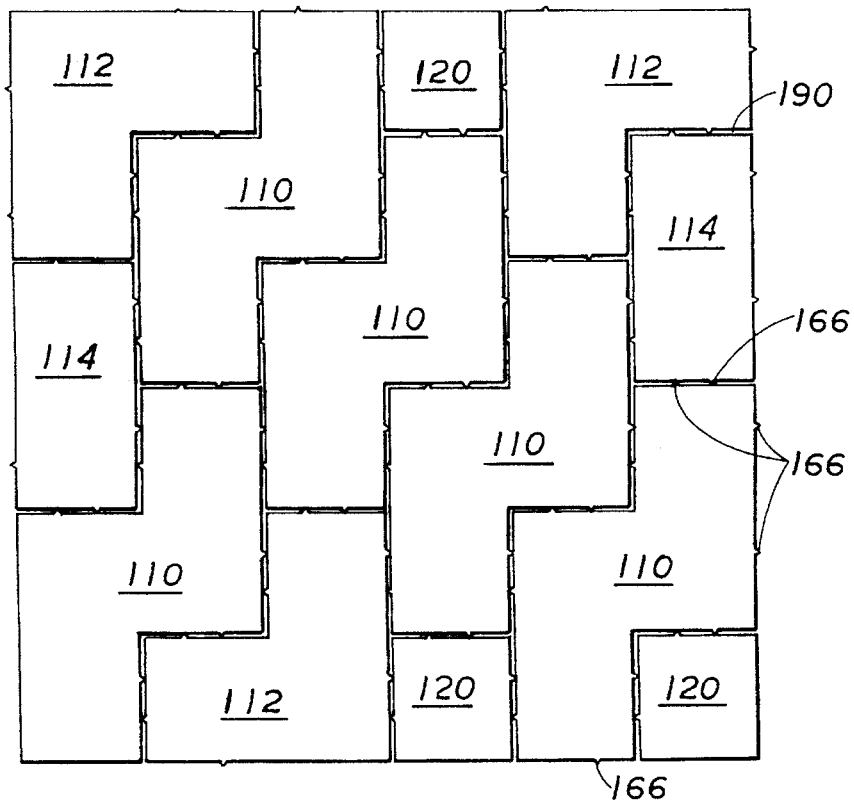
FIG. 8 is a plan view of a plurality of paving stones of FIG. 6, some of which have had sectors fragmented therefrom, and which are arranged to fill a square space.
Figure 9:
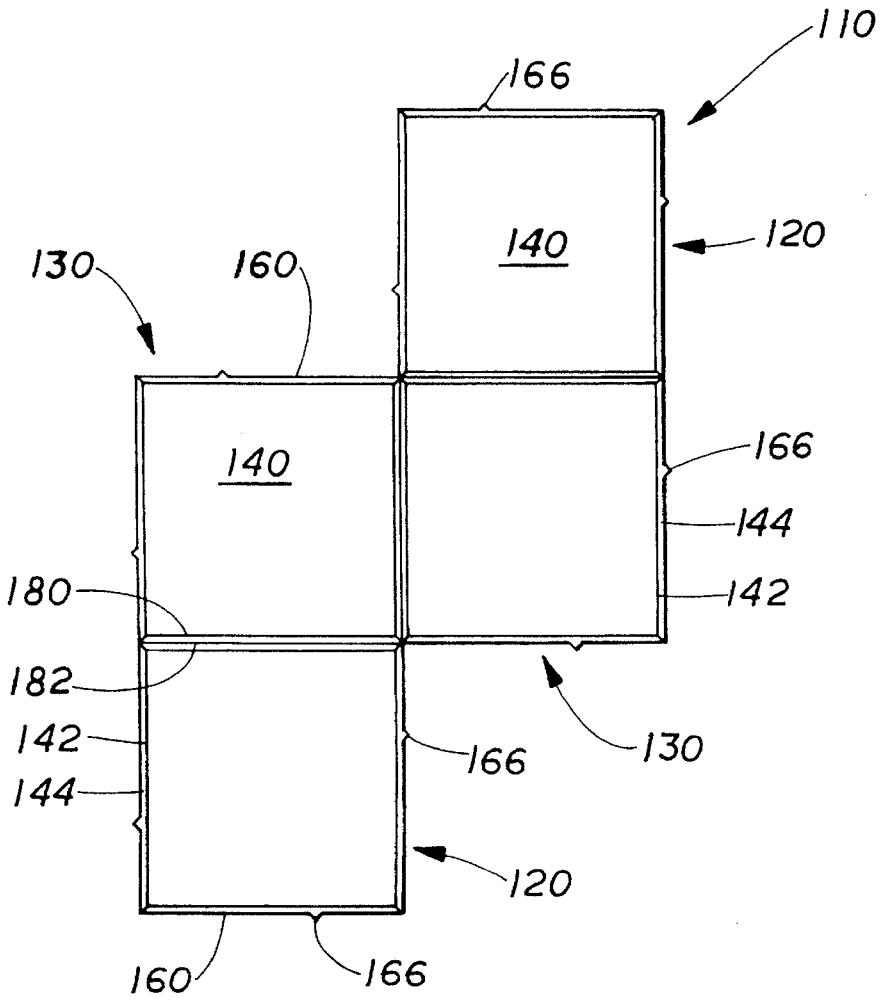
FIG. 9 is a top view of that which is shown in FIG. 6.
Figure 10:
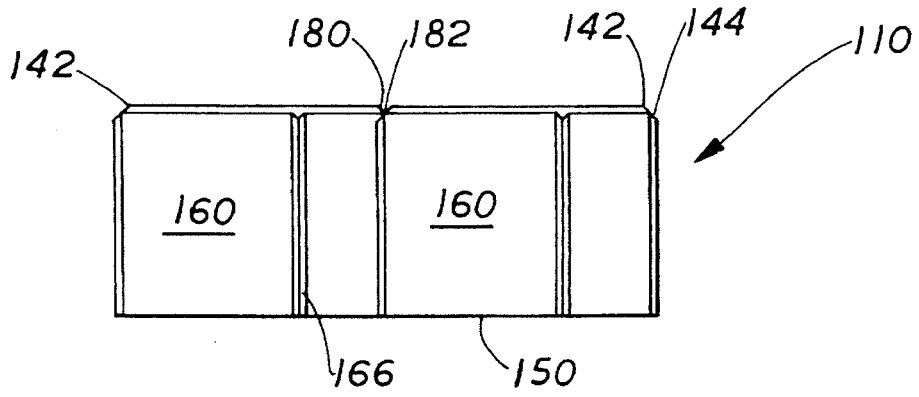
FIG. 10 is a front elevational view of that which is shown in FIG. 6.
Figure 11:
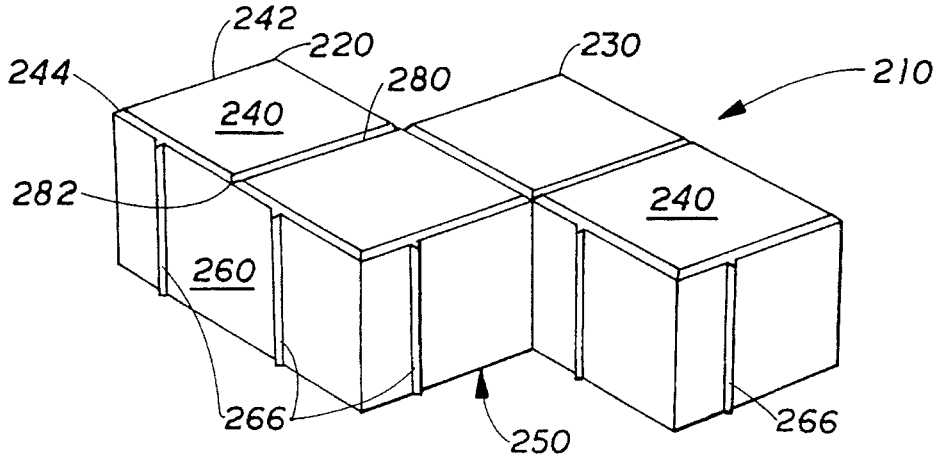
FIG. 11 is a perspective view of a paving stone which represents another alternative embodiment of this invention.
Figure 12:
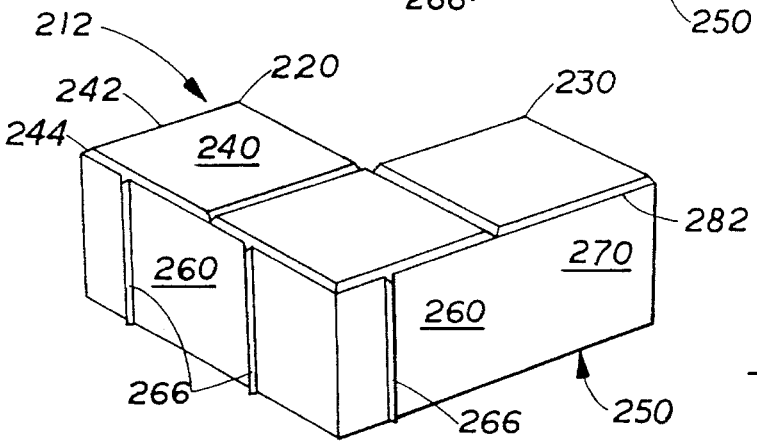
FIG. 12 is a perspective view of the paving stone shown in FIG. 11 with a sector thereof separated therefrom.
Figure 13:
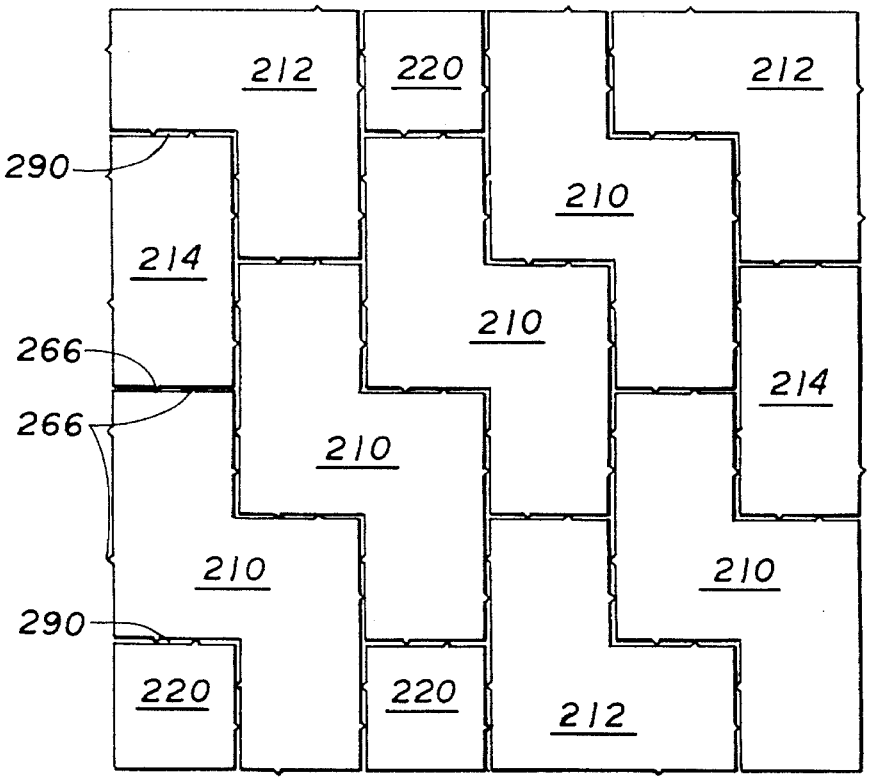
FIG. 13 is a plan view of a plurality of the paving stones of FIG. 11, some of which have had sectors fragmented therefrom, and which are arranged to fill a square space.
Figure 14:
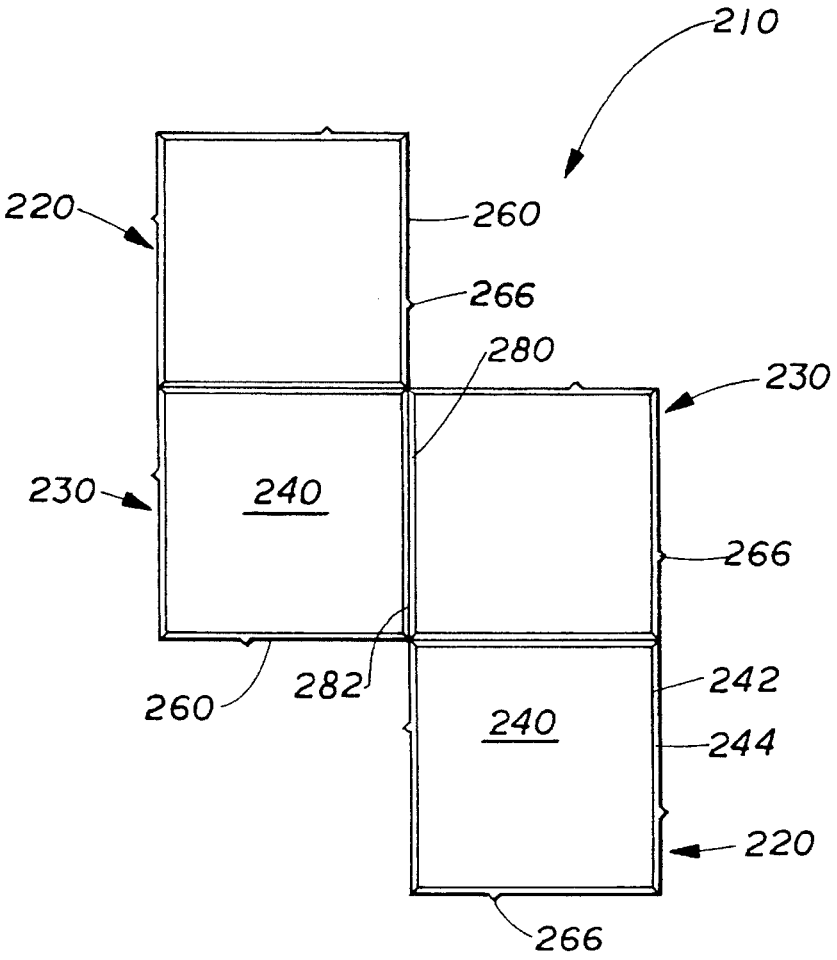
FIG. 14 is a top view of that which is shown in FIG. 11.
Figure 15:
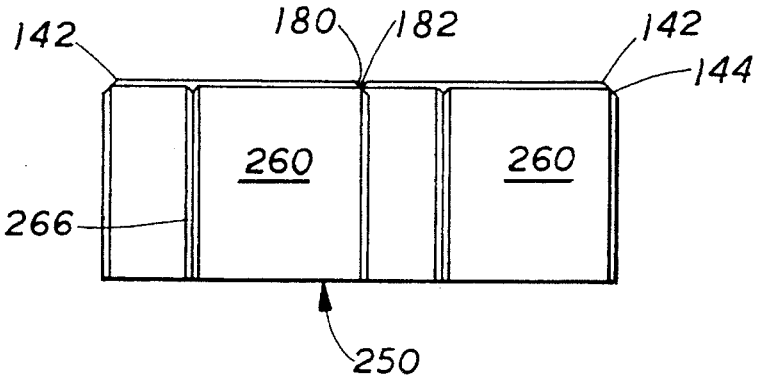
FIG. 15 is a front elevational view of that which is shown in FIG. 11.

As shown in FIG. 8, multiple Z-pavers 110 can be combined together with modified Z-pavers 112, 114 to fill a square or rectangular area without vacant gaps between adjacent pavers 110, 112, 114. When multiple Z-pavers 110 and modified Z-pavers 112, 114 and tip sectors 120 are combined together, an interlocking paving stone surface can be provided. While the array shown in FIG. 8 specifically shows one arrangement of Z-pavers 110, numerous other arrangements of Z-pavers 110 are also possible by rearrangement of the Z-pavers 110, modified Z-pavers 112, 114 and tip sectors 120. The spacers 166 provide an interstice 190 between adjacent Z-pavers 110 which allows sand or other intersticial material to be placed therebetween.

Referring now to FIGS. 11 through 15, details of another alternative embodiment of the cross-paver 10 are shown. Reference number 210 is directed to an S-paver which exhibits an "S-shaped" appearance when viewed from above a top surface 240 thereof. The S-paver 210 is similar to the Z-paver 110 except that the S-paver 210 has tip sectors 220 attached to central sectors 230 in a pattern which is a mirror image of that exhibited by the Z-paver 110.

The S-paver 210 includes two tip sectors 220 and two central sectors 230 attached together beneath V-grooves 280 positioned therebetween within the top surface 240. The top surface 240 is parallel to and spaced from a bottom surface 250. A periphery of the S-paver 210 is defined by an outside surface 260. The outside surface 260 includes spacers 266 thereon which are arranged in a pattern similar to that exhibited by the outside surface 160 of the Z-paver 110.

The S-paver 210 can be fragmented by removing tip sectors 220 therefrom below a crease 282 of the V-grooves 280. When a single tip sector 220 is removed from the S-paver 210, a modified S-paver 212 is provided. If a second tip sector 220 is removed from the modified S-paver 212, a second modified S-paver 214 is created.

Multiple S-pavers 210, modified S-pavers 212, 214 and tip sectors 220 can be combined together to fill an array without vacant gaps therebetween and yet filling a square or rectangular space. The spacers 266 provide an interstice 290 between adjacent S-pavers 210 for the location of intersticial material therebetween.

While the cross-paver 10, Z-paver 110 and S-paver 210 have been described separately, these pavers 10, 110, 210 (and modified versions thereof) can be combined together in a single array covering a surface. In addition, other pavers could be constructed by adding additional tip sectors 20 and central sectors 30 to the existing pavers 10, 110, 210 to provide other unique and versatile frangible pavers.

In use and operation, the pavers 10, 110, 210 are utilized in the following manner. Initially, a layer of sand or other substrate is provided which is approximately planar. This substrate is designed to meet the support needs of the area being paved. The pavers 10, 110, 210 are then placed upon the substrate in a desired pattern. As the paving stones 10, 110, 210 are oriented in place, vacant gaps are identified between the adjacent pavers 10, 110, 210.

A paver 10, 110, 210 is then modified appropriately to fit the gap which has formed. A brick chisel or other linear force-applying device is set over the crease 82, 182, 282 of the V-groove 80, 180, 280 and force is applied thereto, causing a crack to propagate from the top surface 40, 140, 240 through to the bottom surface 50, 150, 250. This process is repeated until an appropriate modified paver is created. This modified paver is then located within the vacant gap.

Once the substrate has been entirely covered by the pavers 10, 110, 210 and all vacant gaps have been filled with modified pavers, intersticial material can be placed within the interstices 90, 190, 290 between the adjacent pavers 10, 110, 210. Edge restraints are utilizable which are linear and which support edges 42, 142, 242 of the pavers 10, 110, 210 without gaps between the pavers 10, 110, 210 and the edge restraints. The pavers 10, 110, 210 provide a paving stone covered surface which exhibits compressive strength not less than 7,000 pounds per square inch. This surface exhibits a porosity of less than 5 pounds of water per cubic foot of material and can withstand at least 50 freeze thaw cycles.

Each of the sectors of the pavers 10, 110, 210 are preferably dimensioned on the top surface 40 and bottom surface 50 to be three inches square. In this way, four sectors together extend for one foot and estimation of an appropriate amount of pavers 10, 110, 210 can be easily calculated and accurately estimated before beginning the surfacing of an area.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. Pavement formed from a plurality of preformed module-type paving stones for use as road structure or other type of traffic bearing surfaces, comprising in combination:

a solid mass of load supporting material interposed between a top surface and a bottom surface, said mass consisting of a plurality of similarly sized rectangular square sectors, each said sector extending from said top surface to said bottom surface including substantially rectangular peripheral faces, and means integral with said paving stone to facilitate linear cracking and dividing of said paving stone from said top surface to said bottom surface between some of said sectors, said linear crack facilitating means includes at least one of said sectors divided by a substantially V-shaped groove formed in said top surface, said groove including a crease at a lowermost portion thereof, said mass having a peripheral surface, wherein said peripheral surface is defined by a plurality of said faces with adjacent pairs of said faces intersecting to form corners on said mass, each of said faces having a single protruding rib thereon extending between said top and bottom surfaces and being parallel to said corners to define a spacer, the spacers on each respective pair of intersecting faces being disposed on said faces wherein the spacer on one of said faces is spaced from said intersection a distance substantially equal to one-third the width of said faces, and the spacer on the other of said pair of faces is spaced from said intersection a distance substantially equal to two-thirds the width of said faces.

2. The paving stone of claim 1 wherein a side surface extends perpendicularly between said top surface and said bottom surface in a location surrounding a periphery of said paving stone, said side surface including means to interlock with adjacent similar paving stones, and each substantially square sector which is spaced from a center of the paving stone extending as a tip sector from a similarly sized central sector, said tip sectors extending from said central sector in a direction perpendicular to a direction of extension of adjacent said tip sectors, said tip sectors spaced from adjacent said tip sectors by substantially square gaps sized similarly to said tip sectors and said central sector, such that when one of said tip sectors is divided from said central sector, said divided tip sector can fit within one of said gaps to cover a rectangular surface.

3. The paving stone of claim 2 wherein said side surface of each of said paving stones includes spacers thereon extending slightly away from said side surface.

4. The paving stone of claim 3 wherein said side surfaces include planar facets, each said facet including spacers thereon which are offset from a central location of each said facet, said spacers extending linearly perpendicularly between said top surface and said bottom surface, whereby when one of said facets of said paving stone is oriented adjacent another facet of another paving stone with said facets parallel to and coextensive with each other, said spacers of said facets will not impact each other.

5. The paving stone of claim 4 wherein said central sectors are bounded by at least one tip sector separatted from said central sector by said grooves, and said paving stone includes said tip sectors bounded by only one central sector separated from said tip sector by one of said grooves.

6. The paving stone of claim 2 wherein said paving stone includes one of said central sector and four of said tip sectors.

7. The paving stone of claim 2 wherein said paving stone includes two of said central sectors adjacent each other and two of said tip sectors.

8. The paving stone of claim 1 wherein said sectors include sector edges defining a periphery thereof, said sector edges each being linear and having a length similar to a length of each of the other said sector edges of said sector, said sector edges substantially perpendicular to adjacent edges of adjacent sectors, said sector edges and said adjacent edges having a gap therebetween including a size and shape similar to a size and shape of said sectors, such that a sector divided from said adjacent sectors can fit within said gap, whereby each said sector is equilateral.

9. The paving stone of claim 8 wherein said sector edges of each said sector define a square, and wherein said groove extends linearly entirely between all adjacent said sectors.

10. The paving stone of claim 1 wherein each of said sectors is of equal size and shape.

11. A set of interlocking frangible paving stones of uniform shape, each paving stone comprising in combination:

a top surface, a bottom surface spaced from said top surface by a load supporting material, a plurality of linear grooves on said top surface, at least one of said grooves oriented to divide said paving stone into rectangular solid square sectors, each of said sectors extending between said top and bottom surface including substantially rectangular peripheral faces and means formed in at least one of said grooves to facilitate substantially linear separation of one of said sectors from remaining portions of said paving stone, said means to facilitate substantially linear separation is a linear crease at a lowermost portion of said linear grooves, whereby a linear separation is encouraged to form along said linear crease of said linear groove and extend from said top surface down to said bottom surface said mass having a peripheral surface, wherein said peripheral surface is defined by a plurality of said faces with adjacent pairs of said faces intersecting to form corners on said mass, each of said faces having a single protruding rib thereon extending between said top and bottom surfaces and being parallel to said corners to define a spacer, the spacers on each respective pair of intersecting faces being disposed on said faces wherein the spacer on one of said faces is spaced from said intersection a distance substantially equal to one-third the width of said faces, and the spacer on the other of said pair of faces is spaced from said intersection a distance substantially equal to two-thirds the width of said faces.

12. The device of claim 11 wherein said paving stone includes at least one substantially square tip sector with one of said grooves including said means to facilitate linear separation between said tip sector and remaining portions of said paving stone, and a side wall extends between said top surface and said bottom surface around a periphery of each said paving stone, said side wall including 90 degree inside corners and 90 degree outside corners, whereby when said side surface of said paving stone is oriented adjacent a side surface of another similar paving stone, shearing forces between the two said paving stones are resisted, thereby creating an interlocking effect.

13. The device of claim 12 wherein said side wall extends perpendicularly from both the top surface and the bottom surface, said side wall including a spacer thereon extending slightly away from said side wall and extending linearly from said bottom surface to said top surface.

14. The device of claim 11 wherein said paving stone includes a plurality of adjacent tip sectors forming opposite sides of said 90 degree inside corners, and at least one of said sectors is similarly shaped and sized as a gap between said adjacent tip sectors, such that said gaps can be filled by a tip sector separated from one of said paving stones along one of said grooves to fully cover a rectangular surface without need for cutting said paving stones at locations away from said grooves.

15. The device of claim 14 wherein said load supporting material is concrete including portland cement, coarse aggregates and fine aggregates, said concrete exhibiting a compressive strength not less than 5,000 pounds per square inch.

16. A frangible interlocking paving stone for covering a surface without the need for secondary edge stones of differing shape, comprising in combination:

at least one central sector and at least two tip sectors integrally formed together as a unitary mass, said tip sectors and said central sector having a substantially constant thickness, each said sector extending perpendicularly from a substantially square bottom surface to a substantially square top surface, said surfaces spaced by said thickness, wherein said thickness defines substantially rectangular faces between said top and bottom faces, each said sector of substantially equal size, each said tip sector spaced from other said tip sectors, of a common paving stone, and contacting at least one of said central sectors, a groove between each said tip sector and a contacting said central sector, said groove including means to facilitate substantially perpendicular fracture of said paving stone from said top surface to said bottom surface, severing one of said tip sectors from a previously contacting said central sector, and said means to facilitate substantially vertical fracture of said paving stone includes a linear crease at a lowermost portion of said groove, mass having a peripheral surface, wherein said peripheral surface is defined by a plurality of said faces with adjacent pairs of said faces intersecting to form corners on said mass, each of said faces having a single protruding rib thereon extending between said top and bottom surfaces and being parallel to said corners to define a spacer, the spacers on each respective pair of intersecting faces being disposed on said faces wherein the spacer on one of said faces is spaced from said intersection a distance substantially equal to one-third the width of said faces, and the spacer on the other of said pair of faces is spaced from said intersection a distance substantially equal to two-thirds the width of said faces.

17. The paving stone of claim 16 wherein said paving stone includes at least two gaps, each said gap adjacent to sector side edges having a length similar to a width of said square tip sectors and oriented perpendicular to each other, such that a square said tip sector which has been separated from a previously contacting said central sector can fit into said gap with a first two sector side edges of said separated square tip sector adjacent said two sector side edges adjacent said gap and a second two sector side edges oriented in planes which are coplanar with other side edges of said paving stone, whereby a gap can be filed by a sector.

18. A frangible paving stone for covering a surface without the need for secondary edge stones of differing shape, comprising in combination:

at least one central sector and at least two tip sectors integrally formed together as a unitary mass, said tip sectors and said central sector of similar size having a substantially constant thickness, each said sector extending perpendicularly from a substantially square bottom surface to a substantially square top surface, said surfaces spaced by said thickness, wherein said thickness defines substantially rectangular faces between said top and bottom surfaces each said sector including an edge surrounding said top surface, said edge including a bevel, each said tip sector spaced from other said tip sectors, of a common paving stone, and contacting at least one of said central sectors, a V-shaped groove between each said tip sector and a contacting said central sector, said V-shaped groove including means to facilitate substantially perpendicular fracture of said paving stone from said top surface to said bottom surface, severing one of said tip sectors from a previously contacting said central sector, said severed tip sector and said central sector each including one wall of the V-shaped groove wherein each wall of the V-shaped groove simulates the appearance of said bevel, said mass having a peripheral surface, wherein said peripheral surface is defined by a plurality of said faces with adjacent pairs of said faces intersecting to form corners on said mass, each of said faces having a single protruding rib thereon extending between said top and bottom surfaces and being parallel to said corners to define a spacer, the spacers on each respective pair of intersecting faces being disposed on said faces wherein the spacer on one of said faces is spaced from said intersection a distance substantially equal to one-third the width of said faces, and the spacer on the other of said pair of faces is spaced from said intersection a distance substantially equal to two-thirds the width of said faces.

* * * * *